US007256351B2

(12) United States Patent
Dillon et al.

(10) Patent No.: US 7,256,351 B2
(45) Date of Patent: Aug. 14, 2007

(54) JACKET CONSTRUCTION HAVING INCREASED FLAME RESISTANCE

(75) Inventors: Scott Dillon, Great Bend, KS (US); Douglas S. Warren, Great Bend, KS (US); Christopher W. McNutt, Woodstock, GA (US)

(73) Assignee: Superior Essex Communications, LP, Atlanta, GA (US)

( * ) Notice: Subject to any disclaimer, the term of this patent is extended or adjusted under 35 U.S.C. 154(b) by 0 days.

(21) Appl. No.: 11/046,058

(22) Filed: Jan. 28, 2005

(65) Prior Publication Data

US 2006/0169479 A1 Aug. 3, 2006

(51) Int. Cl.
*H01B 11/02* (2006.01)

(52) U.S. Cl. ..... 174/113 R

(58) Field of Classification Search ..... 174/113 R, 174/113 C, 131 A

See application file for complete search history.

(56) References Cited

U.S. PATENT DOCUMENTS

| | | | | |
|---|---|---|---|---|
| 4,621,169 | A * | 11/1986 | Petinelli et al. | 166/241.3 |
| 4,777,325 | A | 10/1988 | Siwinski | |
| 5,132,488 | A | 7/1992 | Tessier et al. | |
| 5,519,172 | A * | 5/1996 | Spencer et al. | 174/110 R |
| 5,519,173 | A * | 5/1996 | Newmoyer et al. | 174/113 R |
| 5,796,046 | A | 8/1998 | Newmoyer et al. | |
| 5,990,419 | A | 11/1999 | Bogese, II | |
| 6,239,363 | B1 * | 5/2001 | Wooters | 174/47 |
| 6,567,592 | B1 * | 5/2003 | Gimblet et al. | 385/113 |
| 6,687,437 | B1 * | 2/2004 | Starnes et al. | 385/101 |
| 7,196,271 | B2 * | 3/2007 | Cornibert et al. | 174/113 C |
| 2004/0055779 | A1 * | 3/2004 | Wiekhorst et al. | 174/117 AS |
| 2004/0149483 | A1 * | 8/2004 | Glew | 174/113 C |
| 2005/0006132 | A1 * | 1/2005 | Clark | 174/113 C |
| 2005/0051355 | A1 * | 3/2005 | Bricker et al. | 174/113 R |
| 2005/0133246 | A1 * | 6/2005 | Parke et al. | 174/113 R |
| 2007/0044996 | A1 | 3/2007 | Clark | |

OTHER PUBLICATIONS

Systimax GigaSPEED X10D 91 Series Cable, http://www.anixter.com/AXECOM/AXEDocLib.nsf/(UnID)/0850F7CCADFB790586256F6B005F9962/$file/91cable.pdf, pp. 1-3, no date.

* cited by examiner

*Primary Examiner*—Chau Nguyen N.
(74) *Attorney, Agent, or Firm*—King & Spalding, LLP

(57) ABSTRACT

A communications cable having increased fire resistance and reduced attenuation and crosstalk includes a core having at least one insulated electrical conductor, and a jacket having an inner surface and a plurality of ribs projecting radially inward from the inner surface, the ribs separated from one another by adjacent channels that extend longitudinally along the length of the cable.

15 Claims, 2 Drawing Sheets

JACKET CONSTRUCTION HAVING INCREASED FLAME RESISTANCE

BACKGROUND

Electrical cables are widely used in telecommunications applications for the transmission of voice, video and data signals. Electrical cables typically include a conductive cable core surrounded by a jacket that provides mechanical strength and protection to the cable core. PVC is commonly used as a cable insulating and jacketing material since it is cheap and, with the addition of various elastomers, can be made extremely flexible, even at lower temperatures.

However, when PVC burns it produces considerable amounts of smoke and releases toxic halogen compounds, which account for many fire-related deaths. To reduce the risk of fire propagating through a building's ductwork, safety codes often require that plenum-rated cables meet industry standards for low smoke generation and low flame spread. Cables obtain the plenum rating upon successfully passing NFPA 262 (UL 910) flame propagation and smoke generation tests, which require that the materials used in conductor insulations and cable jackets be capable of withstanding a specified amount of heat for a specified amount of time without combustion or contributing significantly to the sustenance of a fire.

To successfully achieve a plenum rating, cables are constructed of materials that are more fire resistant and produce less smoke than traditional jacket materials. While there are several versions of PVC with varying characteristics, to Applicants' knowledge none are able to pass the plenum test. Some versions of PVC and polyolefins may attain plenum capability when combined with certain other polymers that are more fire resistant. However, maintaining the safety margins against the plenum flame test is sometimes difficult. Construction must be highly controlled and, in some instances, cable designs that pass the test one time may not pass on another trial.

More successful methods for increasing flame resistance include adding halogens to the jacket material. Fluoropolymers are commonly used to increase the fire resistance of the material. The most common thermoplastic polymer in plenum cables is fluorinated ethylene-1-propylene copolymer (FEP). See, for example, U.S. Pat. Nos. 5,841,072, 5,841,073, and 5,563,377, the disclosures of which are incorporated herein by reference.

Unfortunately, fluoropolymers are much more expensive to manufacture, thus the higher cost of plenum rated cables. Furthermore, fluoropolymers are tougher and more difficult to extrude, resulting in plenum cables that are not as flexible as PVC cables. Some cables include a composite of FEP and other materials. See, for example, U.S. Pat. No. 5,932,847, the disclosure of which is incorporated herein by reference. However, these composite designs often require twist length or expansion consideration to minimize signal propagation delay skew, as well as increase manufacturing complexity and product cost.

There is also a high concern about the true safety of halogen-based cables. When halogen-based cables burn (at whatever level they produce smoke), the smoke is corrosive and contains poisonous gases. Halogen-free polymer materials require complicated self-extinguishing formulations of compounds in order to obtain low smoke cable products. These materials add cost, complexity and may degrade the electrical performance of the cable.

SUMMARY

In one of many possible embodiments, a communications cable includes a core having at least one insulated electrical conductor, and a jacket having an inner surface and a plurality of ribs projecting radially inward from the inner surface, such that ribs are separated by adjacent channels.

Another embodiment provides a method of making a cable by forming a plurality of ribs on an inner surface of a cable jacket, wherein the ribs project radially inward from the inner surface and run longitudinally along the length of the cable, and wherein the ribs are separated from neighboring ribs by adjacent channels; and enclosing a cable core within the cable jacket, the cable core having at least one insulated electrical conductor.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

The following description includes specific details in order to provide a thorough understanding of the present cable and methods of making and using it. The skilled artisan will understand, however, that the products and methods described below can be practiced without employing these specific details. Indeed, they can be modified and can be used in conjunction with products and techniques known to those of skill in the art in light of the present disclosure.

Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Figure 1:
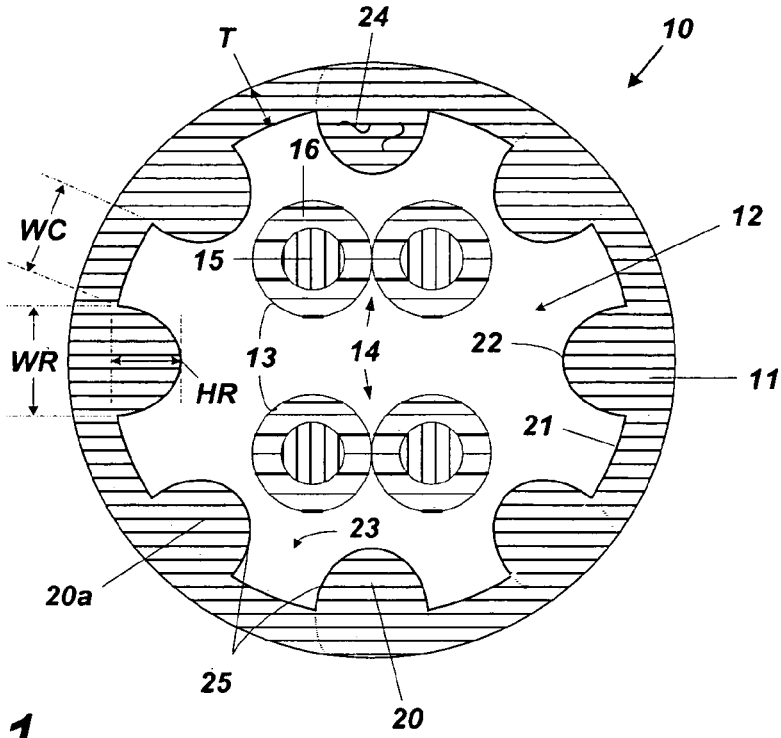
FIG. 1 shows a cross-section of one embodiment of a cable having a ribbed jacket.

Referring now to the Figures, FIG. 1 depicts a cross-section of one embodiment of a cable (10) having a jacket (11) that increases flame resistance and reduces the dielectric around a cable core (12) while maintaining the cable core (12) position. The cable (10) includes a cable jacket (11) surrounding a cable core (12), which runs longitudinally along the length of the cable. The core (12) is generally hollow, but typically includes insulated conductors (13), twisted pairs (14) and/or coaxial cables (not shown) that also run along the length of the cable. The conductors (13) and twisted pairs (14) can be made of any electrical conductor (15) such as metal and metal alloys, but are typically made of single or multi-stranded copper or copper alloys. The conductors are also insulated with one or more polymeric insulation layers (16). Useful polymeric insulations include thermoset, thermoplastic, and ultraviolet light curable polymers. Examples of these include, but are not limited to polyamide, polyamideimide, polyethylene, polyester, polyaryl sulfone, polyacrylates and the like. Any arrangement or combination of conductors, twisted pairs and/or coaxial cables may be used as desired. In one embodiment, the cable core (12) includes a plurality of twisted pairs (13) of insulated conductors (14).

The jacket (11) preferably runs along the length of the cable and completely surrounds the cable core (12). The jacket (11) has an inner surface (21) and a plurality of ribs (20) projecting radially inward from the inner surface (21). The ribs (20) can be formed as part of the jacket (11) and thus can be made of the same material as the jacket (11). While there is generally no minimum or maximum number of ribs (20) on the jacket (11), the number used usually depends on their size and shape and the size of the cable (10).

Figure 2:
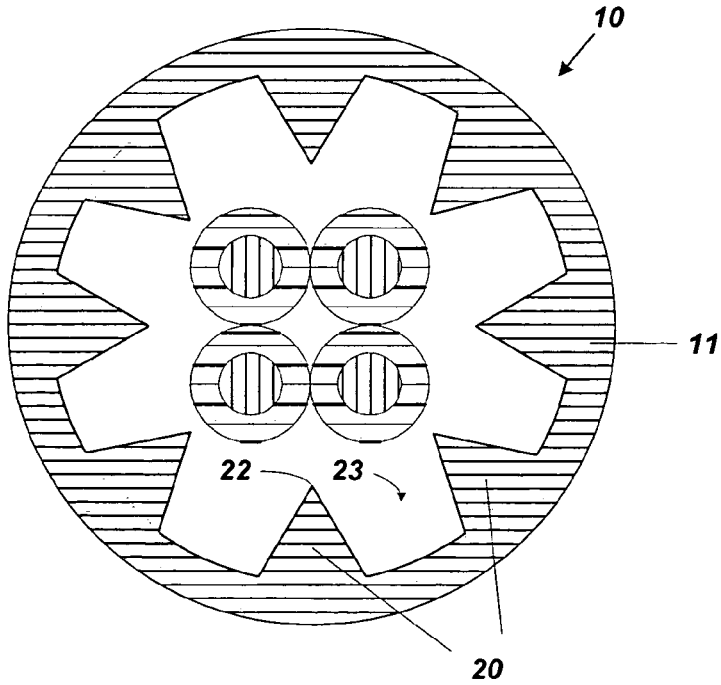
FIG. 2 shows a cross-section of another embodiment of a cable having a ribbed jacket.

In one embodiment the ribs (20) are rounded, elliptical or smooth-edged at their tips (22). This configuration allows the ribs (20) to more effectively maintain the core (12) position and decrease its movement. In another embodiment of the cable (10), shown in FIG. 2, the ribs (20) of the jacket (11) are triangular with pointed tips (22). This configuration provides channels (23) having larger volumes than the channels defined by rounded ribs (20).

Figure 3:
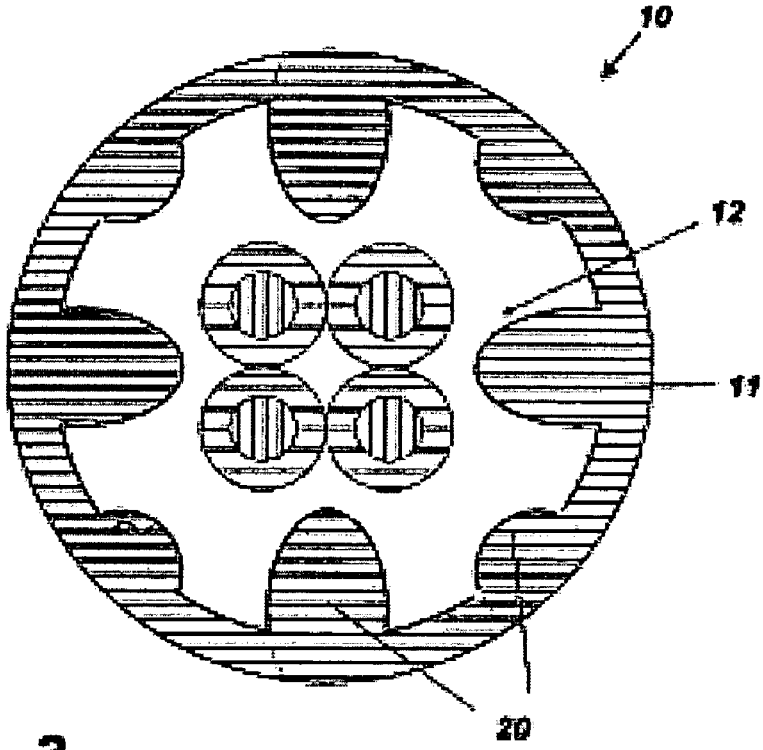
FIG. 3 shows a cross-section of another embodiment of a cable having a ribbed jacket.

Generally, the ribs (20) may all be the same size and shape, as shown in FIG. 1, or they may have differing sizes and shapes, as shown in FIG. 3. The dimensions and shapes of the ribbed configuration may vary according to need and application. Referring again to FIG. 1, the ribs (20) generally have a height (HR) ranging from about 15 to about 35 mils. In one embodiment the height (HR) is about 28 mils. The ribs (20) also have a width (WR) ranging from about 20 to about 45 mils. In one embodiment the width (WR) is about 34 mils. The thickness (T) of the jacket (11) at the narrowest locations, e.g. at the location of the channels (23), can be any thickness commonly used in plenum cables for the materials listed above. Typically, the thickness (T) ranges up to about 40 mils. In one the thickness (T) is about 15 mils.

Each rib (20) is separated from a neighboring rib (20*a*) by an adjacent channel (23) that runs longitudinally along the length of the cable (10) between the two ribs (20, 20*a*). The channels (23) are defined by exposed portions of the inner surface (21) of the jacket (11) and the side walls (25) of the ribs (20). The channels (23) have a width (WC) ranging up to about 40 mils. In one embodiment the width (WC) is about 28 mils. Typically the channels (23) do not contain any conductors (13) or portions of the core (12).

The ribbed jacket configuration reduces the amount of jacket material around the core (12) and insulated conductors (15), and minimizes the contact between the core (12) and the jacket (11). This results in reduced burning and production of smoke. In typical telecommunication cables the core burns and produces smoke more easily than the jacket material. The ribbed jacket configuration increases the distance between the core (12) and fires exterior to or involving the jacket (11), thereby reducing the likelihood that the core (12) will burn.

The ribbed jacket configuration also improves the electrical performance of the cable (10). Instead of surrounding the core (12) with jacket material, the core (12) is surrounded with channels (23) containing air. This reduces the dielectric surrounding the core (12) and insulated conductors (15), thus reducing the amount of attenuation experienced by the electric signal traveling in the core (12). The ribbed configuration also serves to reduce crosstalk in the cable (10). Crosstalk increases significantly when twisted pairs (14) with like pair lay lengths come in close proximity to each other. The ribs (20) hold the core (12) in position and prevent twisted pairs (14) with like pair lay lengths from moving and coming in close proximity to each other.

To further decrease cross talk, the ribs (20) may also be made of a semi-conductive filled or unfilled polymer. Useful semi-conductive filled polymers include polyethylene, polypropylene, polystyrene and the like containing conductive particles, such as carbon black, graphite fiber, barium ferrite, and metal flakes, fibers or powders. Other useful semi-conductive polymers include intrinsically conductive polymers such as polyacetylene and polyphthalocyanine doped with gallium or selenium.

The jacket (11) is also electrically insulating, even though its main purpose is to provide mechanical and environmental protection to the core (12). Thus, the cable jacket (11) can be fabricated from a wide variety of materials serving this function, including thermoset and thermoplastic polymers and polyolefins. In one embodiment, a low-smoke PVC material is used in the jacket (11). In another embodiment, such as where the cable (10) is used in a riser application or cables with twisted pair counts greater than four, the jacket (11) can be made with different PVC materials, LSPVC, PVDF, PVDF/PVC polymers, ETCFE, and other fluoropolymers. These materials can be solid or foamed.

In one embodiment, the jacket (11) is fabricated without any fluoropolymer-based materials, such as ethylene chlorotrifluoroethylene copolymer (ECTFE) and fluroinated ethylene propylene (FEP). Rather than FEP, other fire-resistant polymers, such as polypropylene and polyethylene, may be used. The types and amounts of the fire-resistant polymers that are used depend on the cable transmission requirements, safety standards, physical performance, the desired insulation properties and cost considerations.

The jacket (11) and/or ribs (20) of the cable (10) may also include elongated strength members (24). Strength members (24) can include discrete reinforcing particles, metal rods, or continuous fiber bundles of glass, nylon, graphite, oriented liquid crystalline polymers or aramid (e.g. KEVLAR). For example, in one embodiment the jacket may be extruded over one or more aramid fiber strength members (24) such that the strength members (24) extend along the longitudinal axis of the cable (10) within the ribs (20) of the jacket (11). In another embodiment, the strength members (24) may be metal rods extending radially inward from the jacket (11) within the ribs (20). The jacket (11) and ribs (20) may also comprise extruded oriented liquid crystalline polymers. Discrete reinforcing particles may also be used to add strength to the jacket (11) and ribs (20). Useful reinforcing particles include metal shavings, glass fibers, aramid fibers, graphite fibers, carbon black, clays, and nucleators such as talc or sodium benzoate.

Figure 4:
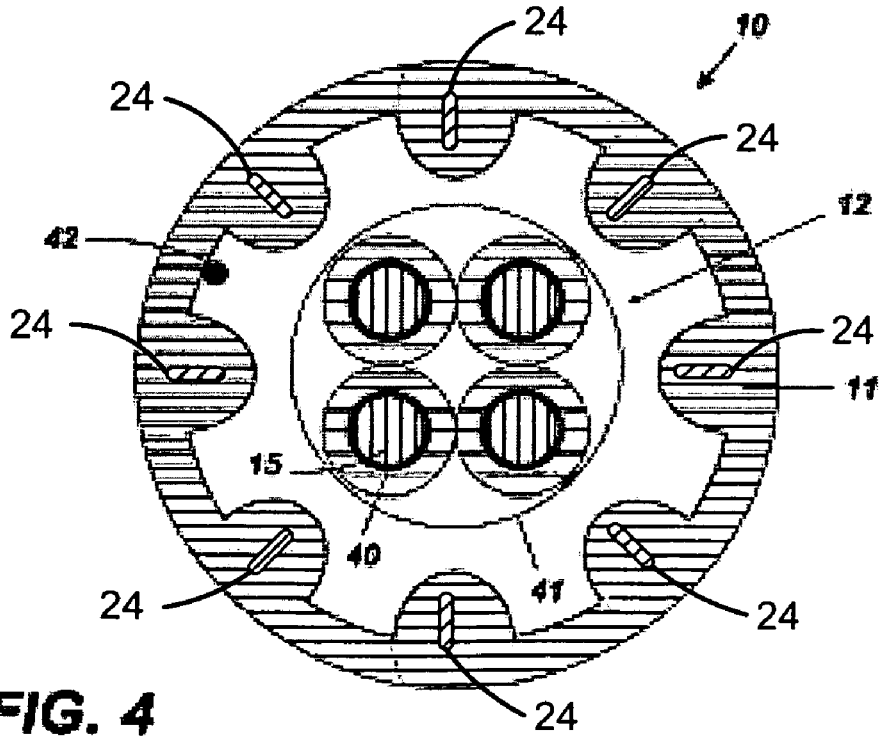
FIG. 4 shows a cross-section of another embodiment of a cable having a ribbed jacket.

As shown in FIG. 4, the cable (10) may also contain separators, tapes, binders, ripcords, sheaths, armors, shield layers, additional jackets or combinations thereof. For example, the metal conductor (15) may also be protected from electromagnetic interference by a grounded shield (40) around the conductor (15). A binder (41) may also be used to contain or confine the conductors along part or all of the length of the communication cable. Several types of binders are known in the art (helical, longitudinal, or counter-helical wound) and can be used in the communication cable (10).

The communication cable (10) may also contain a ripcord (42). The ripcord (42) serves to provide access to the core (12) of the cable (10) by separating the jacket (11). For example, one can grasp an end of the ripcord (42) and pull it outward away from an outer surface of the jacket (11), thereby splitting the jacket (11) and exposing the core (12). Any configuration for the ripcord (42) that achieves this function can be employed in the cable (10), and is not limited to the embodiment depicted in the figure.

The cable described herein can be made as known in the art. Briefly, the conductor (15) is obtained and then the insulation (16) is provided on the conductor by any number of techniques, such as a polymer extrusion process. The desired pairs of conductors (13) are then twisted together, and the twisted pairs (14) are bundled together. Finally, the jacket (11) is then provided around the bundle of conductors (13) and twisted pairs (14). The jacket can be formed by extrusion, pultrusion, molding, or other techniques known to those of skill in the art.

The preceding description has been presented only to illustrate and describe embodiments of the invention. It is not intended to be exhaustive or to limit the invention to any precise form disclosed. Many modifications and variations are possible in light of the above teaching.

What is claimed is:

1. A communications cable, comprising:

a core having at least one insulated electrical conductor disposed therein;

a jacket, disposed circumferentially around said core, comprising:

an inner surface facing said core; and a plurality of ribs projecting radially inward from said inner surface and running longitudinally along the cable, wherein channels separate the ribs from one another; and a ripcord, disposed in one of the channels at the inner surface, for splitting the jacket, wherein said plurality of ribs comprises four ribs having a first size and shape and four ribs having a second size and shape, wherein the four ribs having the first size and shape project radially inward from said inner surface a substantially greater distance than the four ribs having the second size and shape.

2. The communications cable of claim 1, wherein the four ribs having the first size and shape are interleaved between the four ribs having the second size and shape with approximately 45 degrees of separation.

3. The communications cable of claim 1, wherein each of the four ribs having the first size and shape are disposed between two of the four ribs having the second size and shape, and wherein about 45 degrees separates each of the four ribs having the first size and shape from two of the four ribs having the second size and shape.

4. The communications cable of claim 3, wherein each of the plurality of ribs comprises an internal metal rod extending radially inward from the jacket.

5. A communications cable comprising:

a tube providing a longitudinal cavity that has a periphery, the tube comprising:

four first longitudinal protrusions extending along the tube and disposed around the periphery of the longitudinal cavity at increments of about 90 degrees, each having an elliptical cross section projecting into the longitudinal cavity a first distance;

four second longitudinal protrusions extending along the tube, each projecting into the longitudinal cavity a second distance that is substantially less than the first distance, and each disposed around the periphery of the longitudinal cavity between two of the first longitudinal protrusions with about 45 degrees of separation there between;

a plurality of metal rods extending radially inward within the four first longitudinal protrusions or the four second longitudinal protrusions; and an intrinsically conductive polymer;

a ripcord, operative to split the tube in response to a pulling motion, disposed at an inner surface of the tube between one of the four first longitudinal protrusions and one of the four second longitudinal protrusions; and a plurality of insulated electrical conductors disposed in the longitudinal cavity.

6. The communications cable of claim 5, wherein the elliptical cross section has a shape of a truncated ellipse.

7. The communications cable of claim 5, wherein the elliptical cross section comprises a section of an ellipse, the section encompassing a center point of the ellipse.

8. The communications cable of claim 5 wherein the intrinsically conductive polymer comprises polyacetylene doped with gallium.

9. The communications cable of claim 5, wherein the intrinsically conductive polymer comprises polyphthalocyanine doped with selenium.

10. A communications cable comprising:

a jacket circumferentially surrounding a channel and having an inner surface facing the channel;

a plurality of ribs extending longitudinally along the inner surface of the jacket and protruding into the channel; and a plurality of insulated conductors disposed in the channel, wherein the plurality of ribs comprises at least two ribs that protrude into the channel substantially farther than at least two other ribs in the plurality of ribs.

11. The communications cable of claim 10, wherein the jacket comprises a metal rod.

12. A communications cable comprising:

a jacket circumferentially surrounding a channel and having an inner surface facing the channel;

a plurality of ribs extending longitudinally along the inner surface of the jacket and protruding into the channel; and a plurality of insulated conductors disposed in the channel, wherein the plurality of ribs comprises at least two ribs that protrude into the channel at least twice as far as at least two other ribs protrude into the channel.

13. A communications cable comprising:

a jacket circumferentially surrounding a channel and having an inner surface facing the channel;

a plurality of ribs extending longitudinally along the inner surface of the jacket and protruding into the channel;

a ripcord disposed in the channel along the inner surface; and a plurality of insulated conductors disposed in the channel, wherein at least one of the ribs protrudes farther into the channel than at least one other of the ribs.

14. A communications cable comprising:

a cavity extending lengthwise along the communications cable;

a jacket extending lengthwise along the communications cable at a periphery of the cavity;

at least two pairs of conductors disposed in the cavity; and a first protrusion and a second protrusion attached to the jacket and extending into the cavity, the first protrusion extending farther than the second protrusion.

15. The communications cable of claim 14, wherein the first protrusion has a substantially different cross section than the second protrusion.

* * * * *